US005435973A

United States Patent [19]

Zinke

[11] Patent Number: 5,435,973

[45] Date of Patent: Jul. 25, 1995

[54] FCC APPARATUS FOR DE-GASSING SPENT CATALYST BOUNDARY LAYER

[75] Inventor: Randy J. Zinke, Carol Stream, Ill.

[73] Assignee: UOP, Des Plaines, Ill.

[21] Appl. No.: 233,106

[22] Filed: Apr. 25, 1994

Related U.S. Application Data

[62] Division of Ser. No. 983,063, Nov. 27, 1992, Pat. No. 5,316,657.

[51] Int. Cl.[6] ..... F27B 15/10; F27B 15/02

[52] U.S. Cl. ..... 422/144

[58] Field of Search ..... 422/143, 144, 145, 147

[56] References Cited

U.S. PATENT DOCUMENTS

| | | | |
|---|---|---|---|
| 2,440,620 | 4/1948 | Taff | 23/288 |
| 2,440,625 | 4/1948 | Wiemer | 74/275 |
| 2,477,149 | 8/1948 | Wiler | 208/162 |
| 2,529,503 | 11/1950 | Kimball et al. | 422/144 |
| 2,541,801 | 2/1951 | Wilcox | 196/52 |
| 2,612,438 | 9/1952 | Murphree | 23/288 |
| 2,658,031 | 11/1953 | Schutte | 422/216 |
| 2,728,642 | 12/1955 | Cunningham et al. | 422/144 |
| 2,958,653 | 11/1960 | Kruse, Jr. | 422/144 X |
| 2,994,659 | 8/1961 | Slyngstad et al. | 208/113 |
| 3,250,696 | 5/1966 | Schutte | 422/144 X |
| 3,355,380 | 11/1967 | Luckenbach | 422/144 X |
| 3,480,406 | 11/1969 | Luckenbach | 422/144 |
| 3,690,841 | 9/1972 | Bunn, Jr. et al. | 23/288 S |
| 3,894,932 | 7/1975 | Owen | 208/74 |
| 4,051,013 | 9/1977 | Strother | 208/78 |
| 4,070,159 | 1/1978 | Myers et al. | 23/288 E |
| 4,220,623 | 9/1980 | Jahnke et al. | 422/144 |
| 4,364,905 | 12/1982 | Fahrig et al. | 422/144 |
| 4,414,100 | 11/1983 | Krug et al. | 208/153 |
| 4,419,221 | 12/1983 | Castagnos, Jr. et al. | 208/113 |
| 4,431,749 | 2/1984 | Hettinger, Jr. et al. | 502/68 |
| 4,435,279 | 3/1984 | Busch et al. | 208/111 |
| 4,500,423 | 2/1985 | Krug et al. | 208/161 |
| 4,946,656 | 8/1990 | Ross et al. | 422/147 |
| 5,143,875 | 9/1992 | Owen et al. | 502/43 |

FOREIGN PATENT DOCUMENTS

| | | | |
|---|---|---|---|
| 541772 | 2/1956 | Canada | 208/162 |

OTHER PUBLICATIONS

Oil & Gas Journal, p. 102, May 15, 1972 edition.

Oil & Gas Journal, p. 65, Oct. 8, 1973 edition.

*Primary Examiner*—Amalia L. Santiago

*Attorney, Agent, or Firm*—Thomas K. McBride; John G. Tolomei

[57] ABSTRACT

A fluidized catalyst contacting apparatus improves the recovery of entrained hydrocarbon gases by providing a de-gassing zone upstream of a conventional stripping zone. The de-gassing zone has a downwardly increasing catalyst density gradient that reduces the void volume of the fluidized catalyst thereby de-gassing hydrocarbon vapors from the catalyst prior to entering a stripping zone. The de-gassing zone is particularly useful in a vented riser arrangement for an FCC reactor where catalyst concentrates along the wall of the reactor vessel as it flows downwardly into the stripping zone. By providing a de-gassing zone to collect the downwardly descending catalyst and remove hydrocarbon vapors, efficiency of a sub-adjacent stripping zone is significantly improved.

9 Claims, 1 Drawing Sheet

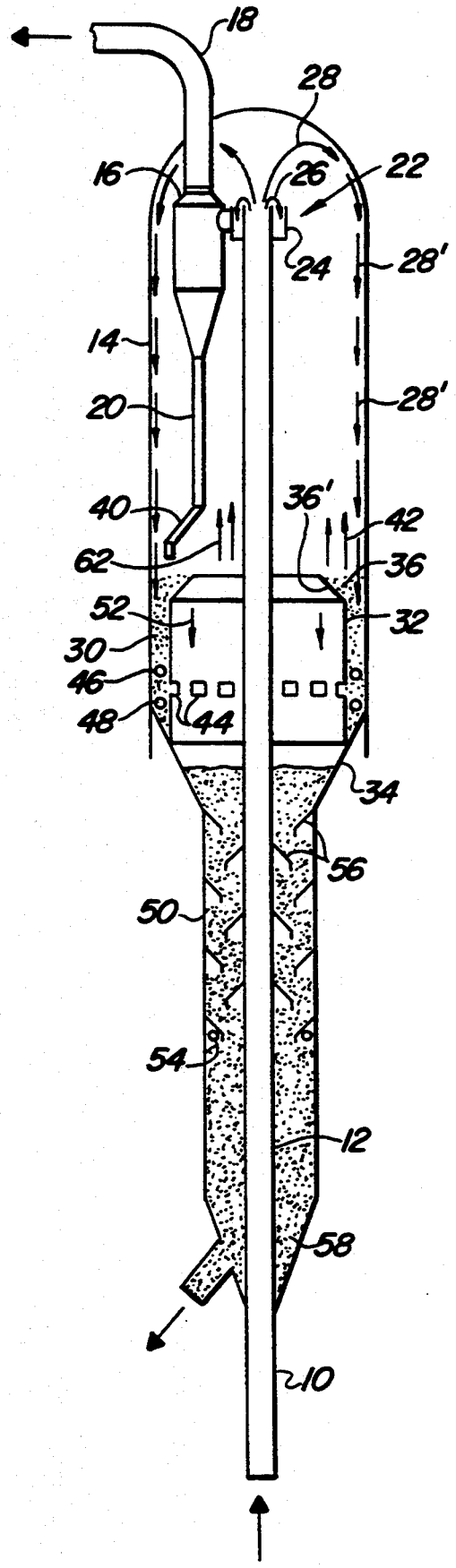
18
28
16
26
22
24
28'
14
20
28'
40
36'
42
62
36
52
32
30
46
48
44
34
56
50
54
12
58
10

FCC APPARATUS FOR DE-GASSING SPENT CATALYST BOUNDARY LAYER

CROSS-REFERENCE TO RELATED APPLICATION

This application is a divisional application of U.S. Ser. No. 07/983,063 filed Nov. 27, 1992, now issued as U.S. Pat. No. 5,316,657, the contents of which are hereby incorporated by reference.

FIELD OF THE INVENTION

This invention relates broadly to hydrocarbon conversion processes and apparatus. More specifically, the invention relates to fluidized catalytic cracking (FCC) reactors and the recovery of product vapors.

BACKGROUND INFORMATION

Fluidized bed catalytic cracking (commonly referred to as FCC) processes were developed during the 1940's to increase the quantity of naphtha boiling range hydrocarbons which could be obtained from crude oil. Fluidized catalytic cracking processes are now in widespread commercial use in petroleum refineries to produce lighter boiling point hydrocarbons from heavier feedstocks such as atmospheric reduced crudes or vacuum gas oils. Such processes are utilized to reduce the avenge molecular weight of various petroleum-derived feed streams and thereby produce lighter products, which have a higher monetary value than heavy fractions. Though the feed to an FCC process is usually a petroleum-derived material, liquids derived from tax sands, oil shale or coal liquefaction may be charged to an FCC process. Today, FCC processes are also used for the cracking of heavy oil and reduced crudes. Although these processes are often used as reduced crude conversion, use of the term FCC in this description applies to heavy oil cracking processes as well.

The operation of the FCC process is well known to those acquainted with processes for upgrading hydrocarbon feedstocks. Differing designs of FCC units may be seen in the articles at page 102 of the May 15, 1972 edition and at page 65 of the Oct. 8, 1973 edition of "The Oil & Gas Journal". Other examples of FCC processes can be found in U.S. Pat. Nos. 4,364,905 (Fahrig et at); 4,051,013 (Strother); 3,894,932 (Owen); and 4,419,221 (Castagnos, Jr. et al) and the other FCC patent references discussed herein.

A majority of the hydrocarbon vapors that contact the catalyst in the reaction zone are separated from the solid particles by ballistic and/or centrifugal separation methods. However, the catalyst particles employed in an FCC process have a large surface area, which is due to a great multitude of pores located in the particles. As a result, the catalytic materials retain hydrocarbons within their pores and upon the external surface of the catalyst. Although the quantity of hydrocarbon retained on each individual catalyst particle is very small, the large amount of catalyst and the high catalyst circulation rate which is typically used in a modern FCC process results in a significant quantity of hydrocarbons being withdrawn from the reaction zone with the catalyst.

Therefore, it is common practice to remove, or strip, hydrocarbons from spent catalyst prior to passing it into the regeneration zone. It is important to remove retained spent hydrocarbons from the spent catalyst for process and economic reasons. First, hydrocarbons that enter the regenerator increase its carbon-burning load and can result in excessive regenerator temperatures. Stripping hydrocarbons from the catalyst also allows recovery of the hydrocarbons as products. The most common method of stripping the catalyst passes a stripping gas, usually steam, through a flowing stream of catalyst, countercurrent to its direction of flow. Such steam stripping operations, with varying degrees of efficiency, remove the hydrocarbon vapors which are entrained with the catalyst and hydrocarbons which are adsorbed on the catalyst.

The efficiency of catalyst stripping has been increased by using a series of baffles in a stripping apparatus to cascade the catalyst from side to side as it moves down the stripping apparatus. Moving the catalyst horizontally increases contact between it and the stripping medium. Increasing the contact between the stripping medium and catalyst removes more hydrocarbons from the catalyst. As shown by U.S. Pat. No. 2,440,625, the use of angled guides for increasing contact between the stripping medium and catalyst has been known since 1944. In these arrangements the catalyst is given a labyrinthine path through a series of baffles located at different levels. Catalyst and gas contact is increased by this arrangement that leaves no open vertical path of significant cross-section through the stripping apparatus. Further examples of similar stripping devices for FCC units are shown in U.S. Pat. Nos. 2,440,620; 2,612,438; 3,894,932; 4,414,100; and 4,364,905. These references show the typical stripper arrangement having a stripper vessel, a series of baffles in the form of frustoconical sections that direct the catalyst inward onto a baffle in a series of centrally located conical or frustoconical baffles that divert the catalyst outwardly onto the outer baffles. The stripping medium enters from below the lower baffle in the series and continues rising upward from the bottom of one baffle to the bottom of the next succeeding baffle. Variations in the baffles include the addition of skins about the trailing edge of the baffle as depicted in U.S. Pat. No. 2,994,659 and the use of multiple linear baffle sections at different baffle levels as demonstrated by FIG. 3 of U.S. Pat. No. 4,500,423. A variation in introducing the stripping medium is shown in U.S. Pat. No. 2,541,801 where a quantity of fluidizing gas is admitted at a number of discrete locations.

As previously mentioned for reasons of heat balance and product recovery, improvements in the efficiency of FCC stripping are particularly desirable. One way to improve FCC stripping efficiency is to increase the contact time between the stripping fluid and the FCC catalyst. This can be done by extending the length of the FCC stripping zone. The extended length increases efficiency by increasing the relative partial pressure of the stripping fluid, typically steam, in the lower portion of the stripper from which the catalyst normally exits. Furthermore, higher additions of stripping fluid such as steam can also raise the steam partial pressure within the stripping zone thereby serving to further reduce the carryover of hydrocarbons from the stripping zone into the regenerator. However, increasing the length of the stripping zone, or adding additional stripping steam to the FCC stripper, increases the cost of the operation of the unit as well as burdening downstream recovery facilities by the extra circulation and recovery of water. As a result, methods are sought to improve the recovery of hydrocarbons from FCC catalyst without increasing the length, or adding additional quantities of steam to the stripping zone.

BRIEF DESCRIPTION OF THE INVENTION

It has now been found that a number of FCC arrangements produce a concentrated boundary layer of catalyst and that by catching this boundary layer of catalyst in a zone particularly arranged to de-gas hydrocarbons from the catalyst stream, stripping efficiency can be improved without extending the length of the stripping zone, or adding additional stripping fluid.

A common FCC arrangement, referred to as a vented riser, is one form of FCC reactor arrangement that provides a concentrated boundary layer of catalyst within the reactor vessel. In the case of the enclosed vented riser, the boundary layer of catalyst flows near the wall of the vessel. Wherever such a boundary layer of catalyst is formed, it is readily collected in a vertically-extended zone having a cross-sectional area that is relatively small compared to the cross-sectional area of the reactor vessel. The vertically-extended zone increases the density of the catalyst that enters from the boundary layer. Increasing the density of the catalyst in the restricted zone, de-gases hydrocarbons from the catalyst particles. This de-gassed flow of catalyst particles then directly enters a stripping zone. The de-gassed catalyst that enters the stripping zone has a lower partial pressure of hydrocarbons which in turn increases the overall stripping gas partial pressure within the stripping zone, and raises the overall stripping efficiency. By de-gassing the hydrocarbons in this manner, stripping efficiency can be raised by as much as 35%.

Accordingly in one embodiment, this invention is a product recovery method for a hydrocarbon conversion process that contacts a hydrocarbon-containing feedstream with a particulate catalyst. In the method, a hydrocarbon-containing feedstream contacts catalyst in a confined reaction zone. The confined reaction zone discharges the catalyst into a reactor vessel and establishes a localized region in the reactor vessel through which a downwardly flowing stream of catalyst particles pass at a higher density relative to the average catalyst density in the reactor vessel. A vertically-extended de-gassing zone receives at least a portion of the flowing stream of catalyst through an inlet. The catalyst in the de-gassing zone is maintained with a downwardly increasing catalyst density gradient. At least a portion of the catalyst from a higher density region of the de-gassing zone passes into a stripping zone. A stripping gas contacts catalyst in the stripping zone, and stripped catalyst is recovered from the stripping zone.

In a more limited embodiment, this invention is a process for recovering hydrocarbons and stripping catalyst in a reactor and stripper of a fluidized catalytic cracking process. The process comprises contacting a hydrocarbon-containing feedstream with the catalyst in a riser conversion zone. The riser discharges catalyst upwardly from its end into the reactor vessel, such that the catalyst passes as a concentrated stream along the wall of the reactor vessel. At least a portion of the concentrated stream of catalyst enters an annular inlet of a vertically-extended de-gassing zone. A fluidizing gas passes into the lower portion of the de-gassing zone. The fluidizing gas maintains a downwardly increasing density gradient for the catalyst throughout the de-gassing zone. At least a portion of the catalyst from a relatively higher density region of the de-gassing zone passes into a subadjacent stripping zone. A stripping gas contacts catalyst in the stripping zone and displaces hydrocarbons that pass upwardly out of the stripping zone along with the stripping fluid. The displaced hydrocarbons and stripping gas by-pass the de-gassing zone and exit the reactor vessel. A stripped catalyst is recovered from the stripping zone.

Other objects, embodiments, and details of this invention can be found in the following detailed description of the invention.

BRIEF DESCRIPTION OF THE DRAWING

The FIGURE shows a cross-section of an FCC reactor vessel having a riser conversion zone, the de-gassing zone of this invention, and a sub-adjacent stripping zone.

DETAILED DESCRIPTION OF THE INVENTION

This invention can improve the recovery of hydrocarbon vapors from any process that contacts vapors with a particulate catalyst in a fluidized manner. This invention will apply where there is an initial separation of hydrocarbon vapors from the catalyst that produces a concentrated stream of catalyst particles that flows through a region of the containment vessel. The de-gassing zone of this invention can have any configuration that will receive the concentrated flow of catalyst particles and will produce a downwardly increasing catalyst density gradient within the de-gassing zone that serves to decrease the void volume of the catalyst and drive hydrocarbon vapors upwardly out of the de-gassing zone. A better appreciation of this invention can be obtained from the FIGURE which shows the application of this invention in an otherwise conventional arrangement of an FCC reactor and FCC stripping zone.

This invention is particularly useful in the operation of an FCC reaction zone. Additional information on the operation of FCC reaction and regeneration zones may be obtained from U.S. Pat. Nod. 4,431,749 and 4,419,221 (cited above); and 4,220,623.

The FIGURE depicts an FCC reactor. The FCC reactor consists of an external riser conduit 10 through which a mixture of catalyst and feed enters the reactor from a lower section of the riser (not shown). The catalyst and feed mixture continues upward into an internal portion 12 of the riser from which it exits into a reactor vessel 14. A cyclone separator 16 receives product vapors, stripping gas and catalyst from reactor vessel 14 and removes entrained catalyst particles from the product vapors. A vapor conduit 18 withdraws product from the top of cyclone 16. Catalyst separated from product vapors returns to the reactor vessel through a dip-leg conduit 20.

The top end 22 of the riser is arranged in a typical vented riser configuration. The operation and arrangement of the vented riser is well known and described in U.S. Pat. Nos. 4,435,279 and 4,070,159, the contents of which are hereby incorporated by reference. As catalyst and vapors exit the top of riser 12 through vented riser arrangement 22, the lighter hydrocarbon vapors turn quickly along flow path 26 to enter a cup 24 before exiting through cyclone 16. The higher density catalyst particles continue on an upward trajectory along a path 28 and descend downwardly along with a substantial proportion of the catalyst travelling near the wall of reactor vessel 14 along a path 28'.

The catalyst travelling along the wall of reactor vessel 14 collects in a de-gassing zone 30. As depicted in the FIGURE, a concentric baffle 32 attached to a bottom cone closure 34 of the reactor vessel forms, together with the vessel wall, the annular de-gassing zone 30 and an annular inlet 36. An inwardly angled section 36' at the top of baffle 32 expands the diameter at the inlet of the annular zone 30 to increase the collection of catalyst flowing down the wall along path 28'. Catalyst from conduit 20 of cyclone 16 can also be arranged to discharge catalyst into the gas disengaging zone. Where the location of cyclone conduit 20 would not ordinarily overlie the annular inlet 36, the end of conduit 20 may use an off-set portion 40 to direct catalyst into the de-gassing zone inlet.

Annular section 30 extends vertically to build a head of catalyst and create a higher pressure in the lower portion of the de-gassing zone thereby creating a downwardly increasing density gradient which serves to decrease the void volume of the catalyst in the lower portion of the de-gassing zone. As the void volume is decreased, de-gassing occurs with the resulting hydrocarbon vapors flowing upwardly out of inlet 36 along path 42. Catalyst from the de-gassing zone now with a decreased hydrocarbon partial pressure exits a relatively high density portion of the de-gassing zone through an outlet or port 44. The use of fluidizing gas in annular zone 30 promotes a free flow of catalyst through the de-gassing zone. So as to not interfere with the de-gassing effect of the de-gassing zone, only a relatively small volume of fluidizing gas enters the de-gassing zone. Ordinarily, the fluidizing gas is restricted in volume to provide a superficial velocity of between 0.25 to 0.5 feet per second through the de-gassing zone. Fluidizing gas may enter the annular de-gassing zone at a location above outer 44 through a distribution ring 46, or at a location below outlet 44 through a distribution ring 48. Admitting fluidizing gas through distribution ring 48 permits greater control of flow through the annular de-gassing zone by increasing or decreasing the addition rate of fluidizing gas. Where the flow rate of catalyst to inlet 36 exceeds the amount of catalyst exiting the de-gassing zone through outlets 44, catalyst overflows top 36' of baffle 32 and falls directly into a sub-adjacent stripping zone 50 along a flow path 52.

Catalyst from outlet ports 44 and any catalyst overflowing inlet 36 enter the inlet of stripper 50. Stripper 50 operates in a conventional manner and countercurrently contacts the catalyst therein with an upwardly rising flow of stripping gas that enters stripping zone 50 through a distribution ring 54. A series of baffles 56 cascade the catalyst back and forth in order to increase the contacting between the catalyst and the stripping fluid. In general, the stripping baffles 56 decrease the average density of the catalyst flowing downward through the stripper such that at least the higher density portions of the de-gassing zone have a higher density than those in the stripping zone. Below distribution ring 54, catalyst collects in a relatively dense bed 58 before a spent catalyst outlet pipe 60 withdraws catalyst for regeneration. Stripping gas and recovered hydrocarbons pass upwardly from stripper 50 through the center of baffle 32 by-passing de-gassing zone 30 and out of the open center of baffle 32 along flow line 62.

This invention is applicable to a wide variety of hydrocarbon conversion processes that contact particulate catalyst in a fluidized manner. De-gassing zone 30 may be located in any portion of a reactor vessel where it will receive a concentrated stream of catalyst relative to the average concentration across the reactor vessel. For example, where a riser separation device produces a concentrated downward flow of catalyst near the center of the reactor vessel, the de-gassing zone may have the opposite arrangement of that shown in the FIGURE. In such an arrangement, catalyst would flow into a central portion of a de-gassing zone while stripping vapors and stripped hydrocarbons from a stripping zone would by-pass the de-gassing zone through an annular passage located to the outside of the central de-gassing zone. Accordingly, the description of this invention in the context of a specific FCC process is not meant to limit the process or apparatus aspects of this invention to the particular details disclosed herein.

What is claimed is:

1. An hydrocarbon conversion apparatus comprising:

a reactor vessel;

a riser conduit having an upwardly directed end for discharging catalyst and hydrocarbons into said reactor vessel;

a vertically extended baffle having an open top and an open bottom, said baffle located in said reactor vessel and subdividing the interior of said reactor vessel to define a de-gassing zone within said reactor vessel below the upwardly directed end of said riser;

a stripping vessel located subadjacent to said reactor vessel;

a first outlet defined by said baffle for passing catalyst from said de-gassing zone to said stripping vessel;

means for passing a stripping gas into said stripping vessel;

a passage defined through said open top and said open bottom of said baffle for said stripping gas to by-pass said de-gassing zone and enter said reactor vessel; and, a second outlet for withdrawing catalyst from said stripping vessel.

2. The apparatus of claim 1 wherein a fluidizing gas distributor passes fluidizing gas into a lower portion of said de-gassing zone and said de-gassing zone is open above said fluidizing gas distributor.

3. The apparatus of claim 1 wherein said stripping vessel is subadjacent to said de-gassing zone and includes a series of stripping baffles for contacting said catalyst.

4. The apparatus of claim 1 further comprising a cyclone separator having a catalyst discharge conduit that withdraws catalyst and hydrocarbons from said reactor vessel and the outlet of said discharge conduit overlies at least a portion of said inlet.

5. An hydrocarbon conversion apparatus comprising:

a reactor vessel;

a riser conduit having an upwardly directed end for discharging catalyst and hydrocarbons into said reactor vessel;

a baffle having an open top and an open bottom, said baffle extending vertically within said reactor vessel and concentrically around said riser conduit to form an annular de-gassing zone between said baffle and the wall of said reactor vessel located below the upwardly directed end of said riser;

a stripping vessel located subadjacent to said reactor vessel;

a first outlet defined by said baffle for passing catalyst from said de-gassing zone to said stripping vessel;

means for passing a stripping gas into said stripping vessel;

a passage defined through said open top and said open bottom of said baffle for said stripping gas to by-pass said de-gassing zone and enter said reactor vessel: and, a second outlet for withdrawing catalyst from said stripping vessel.

6. The apparatus of claim 5 wherein a fluidizing gas distributor passes fluidizing gas into a lower portion of said de-gassing zone and said de-gassing zone is open above said fluidizing gas distributor.

7. The apparatus of claim 5 wherein said stripping vessel concentrically surrounds said riser conduit at a location subadjacent to said de-gassing zone and includes a series of stripping baffles for contacting said catalyst.

8. The apparatus of claim 5 wherein said baffle defines an inlet for said de-gassing zone.

9. The apparatus of claim 5 further comprising a cyclone separator having a catalyst discharge conduit withdraws catalyst and hydrocarbons from said reactor vessel and the outlet of said conduit overlies at least a portion of said inlet.

* * * * *